US012181236B1

(12) United States Patent
Kuhs et al.

(10) Patent No.: US 12,181,236 B1
(45) Date of Patent: Dec. 31, 2024

(54) AMMUNITION MONITORING SYSTEM AND METHOD FOR AMMUNITION MONITORING

(71) Applicant: LunikLabs GmbH, Hamburg (DE)

(72) Inventors: Marcel Günter Kuhs, Heide (DE); Tony Alexander Oehm, Frankfurt am Main (DE)

(73) Assignee: LunikLabs GmbH, Hamburg (DE)

( * ) Notice: Subject to any disclaimer, the term of this patent is extended or adjusted under 35 U.S.C. 154(b) by 0 days.

(21) Appl. No.: 18/725,496

(22) PCT Filed: Dec. 21, 2022

(86) PCT No.: PCT/EP2022/087279
§ 371 (c)(1),
(2) Date: Jun. 28, 2024

(87) PCT Pub. No.: WO2023/126278
PCT Pub. Date: Jul. 6, 2023

(30) Foreign Application Priority Data

Dec. 30, 2021 (DE) ..... 102021006420.8

(51) Int. Cl.
*F41A 19/01* (2006.01)

(52) U.S. Cl.
CPC ..... *F41A 19/01* (2013.01)

(58) Field of Classification Search
CPC ..... F41A 19/01
USPC ..... 42/1.01
See application file for complete search history.

(56) References Cited

U.S. PATENT DOCUMENTS

| | | | | |
|---|---|---|---|---|
| 10,362,278 | B1 * | 7/2019 | Palazzolo | H04N 7/185 |
| 10,869,159 | B1 | 12/2020 | Nguyen | |
| 2019/0281259 | A1 * | 9/2019 | Palazzolo | H04N 7/183 |

FOREIGN PATENT DOCUMENTS

| | | | | |
|---|---|---|---|---|
| DE | 202013008543 | U1 | 3/2014 | |
| DE | 202021105858 | U1 * | 3/2022 | |
| KR | 102130961 | B1 | 7/2020 | |
| KR | 102185545 | B1 | 12/2020 | |
| WO | 2009151713 | A2 | 12/2009 | |
| WO | WO-2019023788 | A1 * | 2/2019 | F42B 33/14 |

OTHER PUBLICATIONS

Greenzweig, Ben. "Bullets and Blockchain," LinkedIn, Sep. 20, 2016, https://linkedin.com/pulse/bullets-blockchain-benjamin-greenzweig.

* cited by examiner

*Primary Examiner* — Samir Abdosh
(74) *Attorney, Agent, or Firm* — Dinsmore & Shohl LLP

(57) ABSTRACT

The invention relates to an ammunition monitoring system (1) with at least one fired-shot sensor (2) assignable to a firearm (3) and with a shooting log device (9), wherein the ammunition monitoring system (1) is designed to record as shooting data, by means of the fired-shot sensor (2), the firing of at least one shot from the firearm (3), achievable by the discharge of a cartridge loaded into the firearm, and to store the recorded shooting data in the shooting log device (9).

The invention also relates to a method for ammunition monitoring, wherein shooting data on the firing of at least one shot from a firearm (3), achieved by the discharge of a cartridge loaded into the firearm, is recorded by at least one fired-shot sensor (2) assigned to the firearm (3) and stored in a shooting log device (9).

13 Claims, 2 Drawing Sheets

AMMUNITION MONITORING SYSTEM AND METHOD FOR AMMUNITION MONITORING

CROSS-REFERENCE TO RELATED APPLICATIONS

This application is a U.S. National Phase of International Patent Application No. PCT/EP2022/087279, entitled "AMMUNITION MONITORING SYSTEM AND METHOD FOR MONITORING AMMUNITION" and filed on Dec. 21, 2022, which claims priority to German Patent Application No. 10 2021 006 420.8 filed Dec. 30, 2021, the entire contents of each are incorporated herein by reference in their respective entireties.

The invention relates to an ammunition monitoring system with at least one fired-shot sensor assignable to a firearm and with a shooting log device, wherein the ammunition monitoring system is designed to record as shooting data, by means of the fired-shot sensor, the firing of at least one shot from the firearm, achievable by the discharge of a cartridge loaded into the firearm, and to store the recorded shooting data in the shooting log device.

The invention also relates to a method for ammunition monitoring, wherein shooting data on the firing of at least one shot from a firearm, achieved by the discharge of a cartridge loaded into the firearm, is recorded by at least one fired-shot sensor assigned to the firearm and stored in a shooting log device.

The system and the method serve in particular to log and monitor ammunition used during firearm use, and may furthermore be employed at all levels in the manufacture, sale and use of ammunition.

PRIOR ART

Systems for monitoring ammunition logistics are already known from the prior art.

For example, WO 2019/023788 A1 relates to a method and to a device for tracking of ammunition sales. Individual cartridges are here marked with identification codes such as barcodes that are recorded at transfer points in a server with data of a purchaser. This allows sold ammunition to be assigned to individual purchasers.

In addition, CN 11 32 564 70 A relates to a weapon equipment management system and to a blockchain-based tracking system relating thereto, in which production, logistics, storage and ordering information of firearm parts and ammunition can be recorded.

However, the prior art lacks solutions relating to the specific use of ammunition in a firearm, in particular to misappropriation of ammunition when it is issued for firing, and to collection of unexpended cartridges.

The object of the present invention is to provide an ammunition monitoring system and a method for ammunition monitoring which can monitor the use of a cartridge from its issue to a firearm user to its firing, and the return of unexpended cartridges, without gaps, without the possibility of manipulation, and proof against tampering. In particular, monitoring of a cartridge should already be possible starting from delivery by a manufacturer or dealer of ammunition.

This object is achieved by an ammunition monitoring system and by a method for ammunition monitoring according to the independent claims. Advantageous embodiments of the invention are the subject matter of the sub-claims.

DISCLOSURE OF THE INVENTION

In accordance with the invention, an ammunition monitoring system is proposed with at least one fired-shot sensor assignable to a firearm and with a shooting log device, wherein the ammunition monitoring system is designed to record as shooting data, by means of the fired-shot sensor, the firing of at least one shot from the firearm, achievable by the discharge of a cartridge loaded into the firearm, and to store the recorded shooting data in the shooting log device.

Hence it is made sure that the fired-shot sensor is, when the ammunition monitoring system is used for the intended purpose, actually assigned to the firearm. The firearm per se is however interchangeable and to that extent not a part of the ammunition monitoring system. Instead, the fired-shot sensor/the ammunition monitoring system is usable for different firearms, such that in accordance with the invention the fired-shot sensor is generally speaking only assignable to one firearm, and is consequently assigned to the appropriate firearm only when the ammunition monitoring system is used for the intended purpose.

The ammunition monitoring system is thus designed, in particular when used for the intended purpose, to detect and to log every single cartridge/shot fired from the firearm, and to that extent also a sequence of shots or a plurality of fired cartridges.

The ammunition monitoring system thus offers the possibility of tracking the disappearance or the unauthorized removal of ammunition without gaps and without the possibility of manipulation. This is achieved by a sequential transfer of responsibility in conjunction with inalterably secured and verified sensor data, which is stored with the aid of a preferably blockchain-based solution, in particular in a blockchain which is only accessible for authorized users. It is thus achieved, by means of the ammunition monitoring system in accordance with the invention, that the currently used and non-transparent method of ammunition issue and ammunition monitoring with the aid of a shooting log is rendered superfluous and is protected against abuses by the use of the latest technology. A shooting log refers to a ledger or book into which the issued and returned ammunition, and possibly also shooting results, are entered—in other words the accounts book of the ammunition issuer.

The ammunition monitoring system is suitable in particular for armed forces and security services, and for public order forces such as the police and security companies. Civilian applications, for example shooting/gun clubs, gun dealers and ammunition distributors etc. also conceivable. The ammunition monitoring system may be used here preferably at shooting ranges, but may also be provided by firearm or ammunition manufacturers. The ammunition monitoring system is generally speaking usable at every level of production and sale of ammunition. In particular, each cartridge receives, at least when it is united with a firearm, in particular already when it is manufactured or delivered, a digital twin in the shooting log device, in particular in a blockchain.

The shooting log device is preferably configured as a decentrally distributed database such as in a blockchain.

The invention may thus also cover scenarios in which the ammunition is centrally or decentrally recorded and individually identified by manufacturers and/or dealers. A digital twin in the form of a token may in this way already be generated in the production facility during production of a single cartridge and logged in the shooting log device.

In particular, the ammunition monitoring system has a plurality of preferably differently, or alternatively identically, designed fired-shot sensors assignable to or assigned to the firearm. In other words, preferably several sensors of the ammunition monitoring system are assignable to or assigned to the same firearm. This results in the advantage that the detection accuracy in respect of the shot fired is further improved.

Preferably, it is provided that for recording of the shooting data the at least one fired-shot sensor, in particular several fired-shot sensors, is, in particular are, mountable on or mounted on the firearm. This advantageously permits a particularly dependable detection of the shot fired and a secure fitting of the fired-shot sensor(s).

The fired-shot sensor is preferably mounted detachably, so that it can be removed whenever required and used on another firearm. For example, the fired-shot sensor may be designed to be attachable to a KeyMod system of a handguard on a firearm. A Mount-Rail system, an M-Lok system or an MOE Slot system, for example, are suitable to do so. In particular several preferably different types of fired-shot sensors are assigned to or mounted on the same firearm to further improve the detection accuracy.

Alternatively to mounting on the firearm, an arrangement of the fired-shot sensor on the body of a person using the firearm, for example as a sensor (WBAN, or Wireless Body Area Network) worn directly on the body, is also conceivable. In this case, the fired-shot sensor is designed to record the shot or the shooting data from a distance. In particular, the fired-shot sensor would then be assignable not to the firearm, but to the shooter, or assigned when the ammunition monitoring system is used for the intended purpose.

The fired-shot sensor preferably has an acceleration sensor, a vibration sensor, a position sensor, a temperature sensor, a gyroscope, an angle sensor, an orientation sensor and/or an acoustic sensor, such that the fired-shot sensor is designed to record as shooting data at least the firing of the shot, in particular at least the firing of a sequence of shots, a number of shots, a firing angle and/or a firing position. This means that the fired-shot sensor is preferably designed as a fired-shot sensor system, which has for example an acceleration sensor, an acoustic sensor and an angle sensor, and to that extent has several functions with regard to recording the firing of a shot, or is in a position to synchronously record several parameters indicating the firing of a shot. This advantageously assures dependable detection of the firing of a shot.

Alternatively, the fired-shot sensor is designed as one of the stated sensor variants and has to that extent only one of the corresponding functions. Advantageously, the fired-shot sensor is in this case designed technically uncomplicated and to that extent inexpensive. Preferably, several fired-shot sensors, each with only one function that differs from the function of the other fired-shot sensors, are then provided in order to improve the detection accuracy, said sensors being assigned to the same firearm, as already described above.

According to a preferred development, the fired-shot sensor has at least one storage device for at least temporary storage of recorded shooting data. This results in the advantage that dependable storage of the recorded shooting data is always assured, for example when there is a fault or even a failure in the shooting log device. The storage device may be designed as an intermediate memory, from which the shooting data may be read by the shooting log device or by an interposed mobile communication device, e.g. an app on a smartphone.

Particularly preferably, the shooting log device is designed as a data server, in particular as a cloud-based data server, wherein the fired-shot sensor is designed to transmit the shooting data to the data server in wireless or wired manner. Advantageously, the ammunition monitoring system is manufacturable at comparatively low expense as a result. The fired-shot sensor may use an RFID/NFC technology, Bluetooth, WLAN, mobile telecommunication (2G, 3G, 4G, 5G), but also a cable connection (USB or the like), for transmission of the shooting data. An IEEE 802.15.4 transmission protocol for a wireless sensor network (WSN) is suitable for a radio network connection. It is furthermore conceivable that the fired-shot sensor is connectable into a network of a plurality of fired-shot sensors which can mutually communicate shooting data to the shooting log device, for example via a master sensor.

Preferably, it is provided that the ammunition monitoring system has a mobile communication device, wherein the fired-shot sensor transmits the shooting data to the mobile communication device in wireless or wired manner, and that the mobile communication device comprises the shooting log device or transmits the shooting data to the shooting log device in wireless or wired manner. Advantageously, a communications interface for a user of the ammunition monitoring system is provided with the mobile communication device. The mobile communication device may be provided as an app on a smartphone, tablet, smartwatch or the like. Communication is possible by means of RFID and NFC technology, wherein a transmission of shooting data via the mobile communication device into the internet or intranet may subsequently take place for the purpose of transmission to the shooting log device, or the mobile communication device comprises the shooting log device.

According to a preferred development, it is provided that the shooting log device has a blockchain data structure for filing of the shooting data. Security of the shooting data from manipulation is advantageously assured by means of the blockchain data structure. Furthermore, this is an inexpensive solution with outstanding data protection, in particular due to the possibility of a decentralized network architecture.

Particularly preferably, the blockchain data structure has an accounting system for the cartridge which comprises a digital copy of the cartridge and covers the period at least from delivery of the cartridge, in particular from manufacture of the cartridge, to the shot being fired. As a result, a particularly advantageous possibility is provided for tracking the location of the cartridge, allowing the location of the cartridge at any point in time to be dependably ascertained and assigned to a person of responsibility.

Delivery of the cartridge must be understood, in connection with the present invention, as the time at which the cartridge is transferred from the manufacturer or a supplier to a user using the ammunition monitoring system in accordance with the invention. In other words, the time of delivery coincides with the start of use of the ammunition monitoring system in accordance with the invention.

To that extent, the accounting system permits, in particular by the creation of the digital copy of the cartridge, logging of the lifecycle of the cartridge, from the time of availability of the blockchain and the resultant possibility for logging until the time of the use of the cartridge and its resultant irreversible destruction by the firing of the shot.

According to a preferred development, the ammunition monitoring system has a plurality of further fired-shot sensors assignable to further firearms, wherein the firing of shots from the further firearms is recordable as shooting data by means of the further fired-shot sensors and is storable in the shooting log device. To that extent, several firearms are simultaneously monitorable using the ammunition monitoring system, wherein the respectively recorded data is storable in the same logging device. The ammunition monitoring system is thus advantageously scalable.

In particular, the same type and number of fired-shot sensors are assignable to each of the further firearms, or are assigned when the ammunition monitoring system is used for the intended purpose. For example, the ammunition monitoring system has a gyro-sensor and an acceleration sensor for each further firearm. To that extent, the ammunition monitoring system preferably has a number X of the same type of further fired-shot sensors, each of which is assignable to or assigned to a further firearm from a number X of further firearms.

In a subordinate aspect, a method is proposed for ammunition monitoring, in particular using an aforementioned ammunition monitoring system, wherein shooting data on the firing of at least one shot from a firearm, achieved by the discharge of a cartridge loaded into the firearm, is recorded by at least one fired-shot sensor assigned to the firearm and stored in a shooting log device. This results in the advantages already stated previously.

In particular, shooting data of several firearms is recorded and stored in the shooting log device by means of several fired-shot sensors of the same type which are each assigned to a further firearm. To that extent, the recorded shooting data is transmitted from the fired-shot sensors to the shooting log device and stored there.

Preferably, it is provided that the shooting data comprises the number, direction and/or position of the shot(s) fired. Advantageously, firing of the shots is detectable in a particularly dependable way.

Preferably, the shooting data is stored in a blockchain data structure. As already mentioned in the foregoing, this permits manipulation-proof storage of the shooting data and hence enables dependable tracking of the location of the cartridge.

According to a preferred development, it is provided that accounting for the cartridge is conducted in the blockchain data structure, wherein a digital copy, in particular a token, of the cartridge is generated for accounting purposes, and wherein accounting covers the period at least from delivery, in particular from manufacture of the cartridge, to the shot being fired. This results in the advantages already stated previously in this respect.

In particular, the cartridge is assigned to at least one ammunition wallet for accounting purposes. The ammunition wallet is substantially a personalized digital storage location (storage folder, "wallet"), which to that extent is clearly assignable to one user for the cartridge or its token. If the cartridge is transferred from one user to another (transition of responsibility), then the corresponding token is transferred from the ammunition wallet of the user (the original Person of Responsibility) to the ammunition wallet of the further user (the current Person of Responsibility) or is assigned to said person. Transactions of this type from one ammunition wallet into another ammunition wallet are recorded by the blockchain. The assignment to at least one ammunition wallet and the resultant clear-cut assignment to one user permits a clear trackability of the history/origin of the cartridge in a particularly advantageous way.

Preferably, the shooting data is transmitted from the fired-shot sensor to the shooting log device in wireless or wired manner using a mobile communication device. As already mentioned above, the mobile communication device represents an advantageous user interface. This results in the advantages already stated previously in this respect.

According to a preferred development, it is provided that the shooting log device records firearm data of the firearm and assigns the shooting data and the firearm data to one another. Firearm data must be understood in particular as an individual and unique ID of the firearm which is linked to the fired-shot sensor assigned to the firearm. As a result, the firearm is advantageously clearly identifiable. Assignment to the shooting data allows clear-cut identification of which firearm generated the shooting data. Preferably the firearm data also comprises an ID of the user of the firearm, making it also clear who operated the firearm and fired the shot and hence who expended the cartridge.

Particularly preferably, the shooting log device performs an integrity test on the location of the cartridge. The integrity test is substantially a set/actual comparison of the location of the cartridge(s), i.e. it is determined on the basis of the data recorded in the blockchain how many cartridges were originally available and how many of these cartridges have been fired. Based on that, a check is made of whether the expected number of unexpended cartridges have been returned, for example to a depot, or whether at least one cartridge is missing whose location is to that extent initially unclarified. To that extent, a check is conducted on the history of the cartridge based on the data recorded in the blockchain data, as part of the integrity test. Advantageously, this allows a possible loss, or the location of cartridges, to be dependably clarified or determined, and the user responsible to be identified.

It is pointed out that the system in accordance with the invention is furthermore usable for tracking and for automated stocktaking of all military and also civilian equipment items, which are for example trackable digitally using a lead seal and/or an RFID tag attachable in particular during delivery. Electronic tracking may be performed in particular using a movement sensor or change-of-location sensor, which can determine its position for example absolutely via a satellite system, or relatively via mobile radiolocation, and which is connected to the internet for example via a mobile network or wirelessly. It is therefore also possible to trace or track spare parts for vehicles, supplies, personal equipment items etc. in addition to ammunition tracking and logging.

Previously, precise stocktaking data has been available only in a granular form and specifically only at the respective military installation-expanding the use of the system in accordance with the invention to further civilian or military goods allows a general platform for procurement to be provided, which offers the user an overview of stocks at all locations in both the civilian and military fields.

DRAWINGS

Further advantages emerge from the attached drawing description. The drawing shows examples of the invention. The drawing, the description and the claims contain many features in combination. The person skilled in the art will also consider the features individually, and combine them into useful further combinations.

In the figures:

FIG. 1 shows an advantageous ammunition monitoring system 1 in a greatly simplified schematic illustration. The ammunition monitoring system 1 is used/designed to monitor the use of a cartridge from its issue to a firearm user to its firing, and the return of unexpended cartridges, without gaps, without the possibility of manipulation, and proof against tampering.

Figure 1:
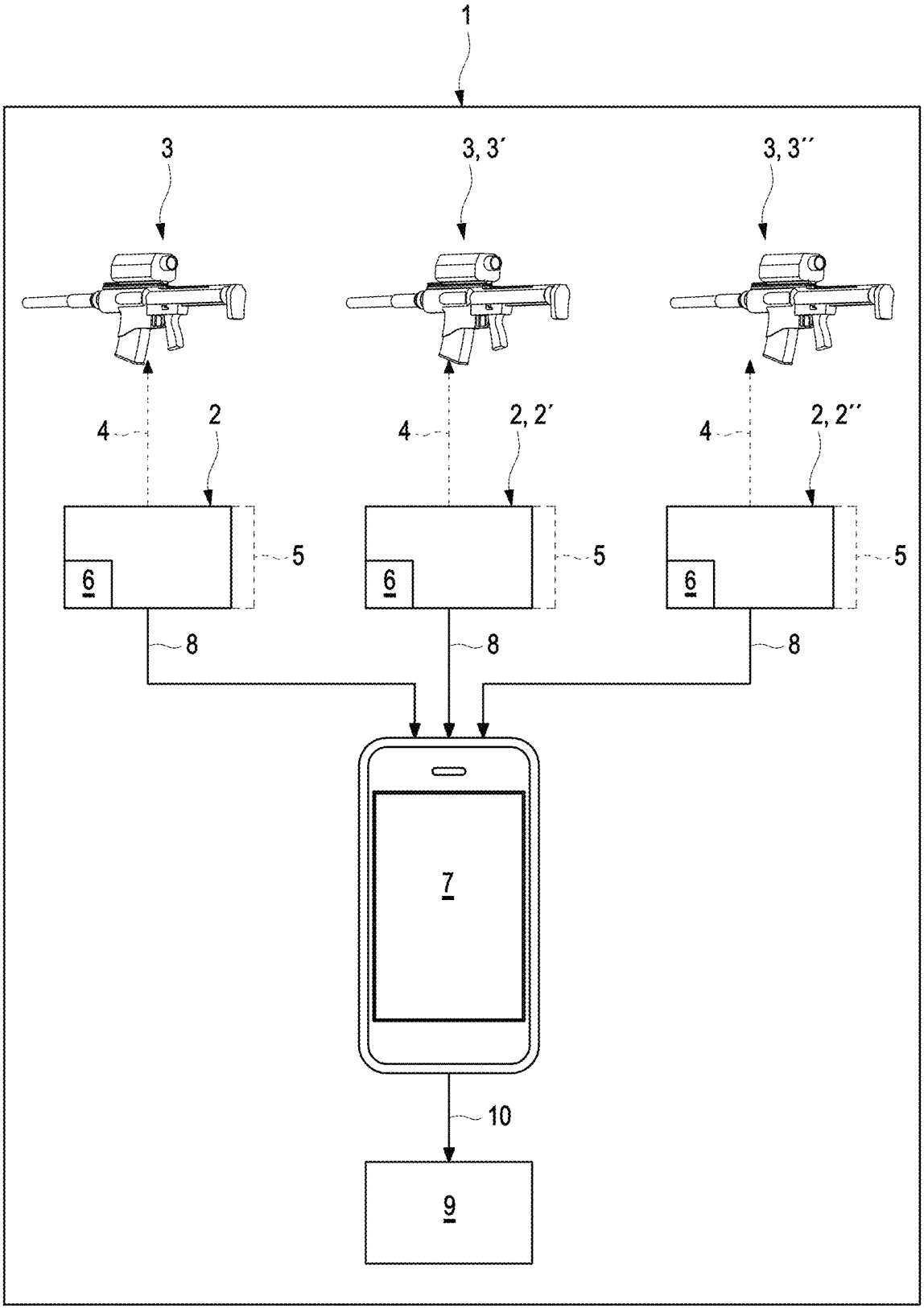
FIG. 1 shows a greatly simplified schematic illustration of an advantageous ammunition monitoring system.

The ammunition monitoring system 1 has at least one fired-shot sensor 2, which is assignable to a firearm 3 or, when the ammunition monitoring system 1 is used for the intended purpose, is assigned to the firearm 3. This assignment of the fired-shot sensor 2 to the firearm 3 is illustrated by way of example in FIG. 1 by a dashed arrow 4. In the example shown in FIG. 1, the ammunition monitoring system 1 has three fired-shot sensors 2 each assigned to one firearm 3. To that extent, a first fired-shot sensor 2 is here assignable to or assigned to a first firearm 3, a second fired-shot sensor 2' to a second firearm 3' and a third fired-shot sensor 2" to a third firearm 3".

Each fired-shot sensor 2 is designed to record as shooting data the firing of at least one shot of the firearm 3, achievable by the discharge of a cartridge loaded into the firearm 3 but not shown here for reasons of clarity. The fired-shot sensor 2 has an acceleration sensor, a vibration sensor, a position sensor, a temperature sensor, a gyroscope, an angle sensor, an orientation sensor and/or an acoustic sensor. To that extent, the fired-shot sensor 2 shown in FIG. 1 must be understood here as a fired-shot sensor system 2, which may thus have any combination of the aforementioned sensor variants. This means that the fired-shot sensor system 2 has a selection of aforementioned sensor variants which are all assigned to the same firearm 3, as is explained in more detail below on the basis of FIG. 2. By the advantageous combination of several sensor variants, the fired-shot sensor system 2 is designed to also record as shooting data the firing of a sequence of shots, the number of shots, a firing angle and/or a firing position.

Optionally, the fired-shot sensor 2 has a mounting device 5, for example a locking device or a guide rail, to allow fitting of the fired-shot sensor 2 to the firearm 3 when the ammunition monitoring system 1 is used for the intended purpose. This optional mounting is explained in more detail below on the basis of FIG. 2.

Furthermore, the fired-shot sensor 2 has at least one storage device 6 for at least temporary storage of the recorded shooting data. The storage device 6 is here designed as an intermediate memory, from which the recorded shooting data is transmitted to a mobile communication device 7 of the ammunition monitoring system 1 or can be read by the mobile communication device 7, as indicated by way of example in FIG. 1 by arrows 8.

The mobile communication device 7 is used as an advantageous communications interface for a user of the ammunition monitoring system 1. The mobile communication device 7 may be designed as an app on a smartphone, tablet, smartwatch or similar. Shooting data is transmitted from the fired-shot sensor 2 to the mobile communication device 7 preferably wirelessly, for example by means of RFID or NFC technology, or alternatively in wired manner. Accordingly, both the fired-shot sensor 2 and the mobile communication device 7 have corresponding communications means.

The ammunition monitoring system 1 also has a shooting log device 9 in which the recorded shooting data is storable or loggable. According to the present example, the recorded shooting data is for that purpose transferred from the mobile communication device 7 to the shooting log device 9 in wireless or wired manner, as shown by way of example in FIG. 1 by a further arrow 10. Alternatively to this, the mobile communication device 7 itself comprises the shooting log device 9, such that in this case the mobile communication device 7 and the shooting log device 9 are designed in one piece and are to be understood as one unit.

The shooting log device 9 is designed here in particular as a cloud-based data server and has a blockchain data structure for filing the shooting data 9. The blockchain data structure has an accounting system of the cartridge, which comprises a digital copy of the cartridge and covers the period at least from delivery of the cartridge, in particular from manufacture of the cartridge, to the shot being fired. The accounting system is to that extent a lifecycle log of the cartridge, from the time of availability of the blockchain to the expending of the cartridge by firing a shot.

The ammunition monitoring system 1 thus offers the possibility of tracking the disappearance or the unauthorized removal of ammunition without gaps and without the possibility of manipulation. This is achieved by a sequential transfer of responsibility in conjunction with inalterably secured and verified shooting data which is stored in the blockchain.

Figure 2:
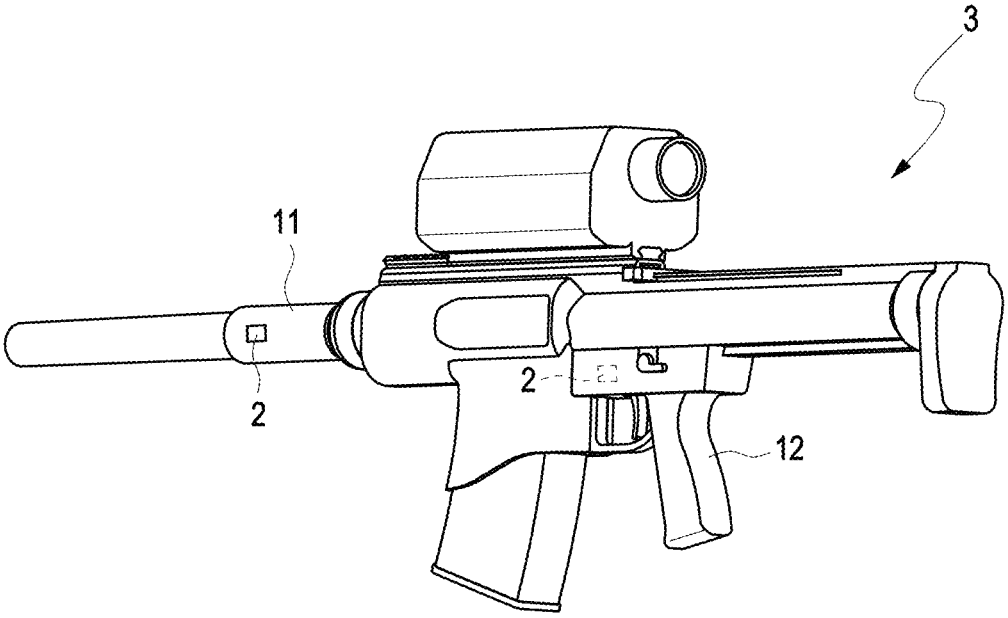
FIG. 2 shows an example for use of a fired-shot sensor of the ammunition monitoring system with a firearm.

FIG. 2 shows an example for use of the fired-shot sensor 2 or fired-shot sensor system 2 with the firearm 3. To that extent, FIG. 2 shows the fired-shot sensor 2 when the ammunition monitoring system 1 is used for the intended purpose. The fired-shot sensor 2 or fired-shot sensor system 2 is thus assigned to the firearm 3.

According to the present example, the fired-shot sensor 2 is mounted on the firearm 3 by means of the mounting device 5. The fired-shot sensor 2 or the fired-shot sensor system 2 here has two of the sensor variants already stated previously, and each mounted preferably detachably on different areas of the firearm 3. In the example shown in FIG. 2, a first sensor variant, for example an angle sensor, is here detachably mounted on a barrel 11 of the firearm 3, and a second sensor variant, for example a kinetic sensor, on a grip 12 of the firearm 3. The sensor variants are here preferably secured such that they can only be removed by authorized persons.

Alternatively to mounting on the firearm 3, an arrangement of the fired-shot sensor 2 on the body of a person using the firearm 3, for example as a sensor (WBAN, or Wireless Body Area Network) worn directly on the body, is also conceivable. In this case, the fired-shot sensor 2 is designed to record the shot or the shooting data from a distance.

The fired-shot sensor 2 or fired-shot sensor system 2 records different exemplary parameters for the firing of a shot, for example the recoil generated when the firearm 3 is fired, and saves this recorded shooting data in the storage device 6. The fired-shot sensor 2 is designed here such that it only detects when the firearm 3 has actually been fired. To that extent, the fired-shot sensor 2 is designed such that any other external effects, such as impacts, knocks etc. can be distinguished from actual shots, such that detection of the shot(s) is not falsified. Optionally, the fired-shot sensor 2 has its own SIM card or is connected to a local network.

Figure 3:
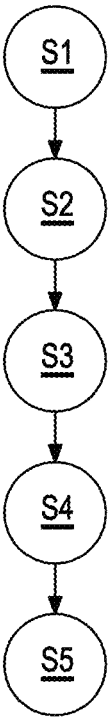
FIG. 3 shows a flow chart to explain by way of example an advantageous method for ammunition monitoring using the ammunition monitoring system.

FIG. 3 shows a flow chart to explain an advantageous method for ammunition monitoring using the previously described ammunition monitoring system 1. In other words, use of the ammunition monitoring system 1 for the intended purpose is illustrated in the following on the basis of FIG. 3. To do so, the sequence of a military shooting exercise is shown by way of example, in which the ammunition monitoring system 1 is used to prevent the misappropriation of ammunition.

The following terms are defined in advance:

POR: Person of Responsibility

Checkpoint: Transfer of responsibility

Token: Digital copy of a cartridge

The method begins with a first step S1 in which a plurality of cartridges or ammunition is delivered, and to that extent the use of the previously described ammunition monitoring system 1 begins.

Upon delivery of the ammunition, it is handed over to a head of depot, the Tier1 POR, to be placed into storage in an ammunition depot, and is checked by that person for completeness, i.e. the head of depot as the Tier1 POR checks whether the same number of cartridges as stated has been delivered. This transfer of ammunition represents one checkpoint. To that extent, every ammunition delivery enters the closed recording system of the ammunition monitoring system 1 when the delivery is accepted by the head of depot as the Tier1 POR. Transfer or acceptance of the ammunition also transfers responsibility for the ammunition to the head of depot as the Tier1 POR. To that extent, the head of depot as the Tier1 POR now has responsibility for ensuring that the ammunition is placed into storage in the ammunition depot according to regulations and is also issued only to authorized persons.

Assuming the ammunition is complete, the number of supplied cartridges is entered by the head of depot as the Tier1 POR into the accounting system of the blockchain of the shooting log device 9, by means of the mobile communication device 7, in the course of step S1. Upon entry, one token, i.e. a digital copy of the cartridge, is created per cartridge on the blockchain and is assigned to an ammunition wallet assigned to the person now responsible for the ammunition, in this case the head of depot as the Tier1 POR, or the token is stored in this ammunition wallet.

Step S1 thus relates to the initial logging of the ammunition on the blockchain. A token is created on the blockchain to represent each cartridge of the ammunition delivery and is transferred with verification of the ammunition delivery into the ammunition wallet of the current POR, in this case a Tier1 POR. The transfer can be tracked at any time based on the data stored on the blockchain or by means of the accounting system. As long as the token is in the ammunition wallet of a POR, that person has personal responsibility, and also only that person may have the ammunition at their disposal during this time. Tokenizing of the ammunition ensures that every cartridge may be individually tracked when later used.

Optionally, the method may also begin in a step S0 preceding step S1. The optional step S0 relates not to the delivery of the ammunition already manufactured previously, but directly to its manufacture. To that extent, the ammunition monitoring system 1 is already used during manufacture of the cartridge at the manufacturer's premises with the optional step S0 or is already available at the time of manufacture of the ammunition. In this case, the corresponding token in the blockchain is already created during manufacture, for example during packaging of the cartridge, and assigned to the ammunition wallet of the person having responsibility at that moment, for example the manufacturer as the Tier0 POR. When the ammunition is delivered in step S1, a corresponding number of tokens is transferred into the ammunition wallet of the head of depot as the Tier1 POR.

In a next step S2 following on from step S1, the ammunition, or at least some of it, is transferred from the head of depot as the Tier1 POR to a head of exercise as the Tier2 POR for the purposes of a shooting exercise, wherein responsibility for the transferred ammunition passes to the head of exercise as the Tier2 POR. The head of exercise as the Tier2 POR counts the transferred ammunition and confirms the number and transfer of the cartridges by means of an appropriate input into the mobile communication device 7. This transfer represents a further checkpoint, which is also stored on the blockchain. The corresponding tokens are again transferred, this time from the ammunition wallet of the head of depot as the Tier1 POR into the ammunition wallet of the head of exercise as the Tier2 POR.

To that extent, in step S2 the further transfer is also entered by means of the mobile communication device 7 into the accounting system of the blockchain, or is recorded by the latter and filed consecutively as a transaction on the blockchain. To that extent, this transfer too may be tracked at any time, in particular using the mobile communication device 7.

In a subsequent step S3, the ammunition is transferred by the head of exercise as the Tier2 POR to at least one soldier as a Tier3 POR for the purpose of conducting the shooting exercise. This transfer represents a further checkpoint which is also registered on the blockchain. The head of exercise as the Tier2 POR preferably possesses single access to the mobile communication device 7 and enters in the latter the number, the type and the person to whom the ammunition for the shooting exercise is issued. Starting from this point in time, the person, in this case at least one soldier as a Tier3 POR, to whom the ammunition was issued is the Person of Responsibility for this ammunition, so that the corresponding tokens are transferred from the ammunition wallet of the head of exercise as the Tier2 POR to the ammunition wallet of the soldier as a Tier3 POR.

Firearm data of the firearm 3 used by the soldier as a Tier3 POR is also registered here. The firearm data is in particular the type of firearm, a firearm serial number and/or a personal ID of the soldier as a Tier3 POR. The corresponding firearm data is linked to the fired-shot sensor 2 mounted on the firearm 3 and may be scanned in for registration, for example by means of the mobile communication device 7, such that no additional manual effort is necessary for recording the firearm data.

The fired-shot sensor 2 records as shooting data every shot fired during the shooting exercise and saves this data in its intermediate memory 6. As already mentioned above, the fired-shot sensor 2 is designed such that a shot is clearly distinguishable for any other external effects. In particular, the fired-shot sensor 2 is designed such that it can precisely document when, how often and where the correspondingly assigned firearm 3 was fired. In particular, every shot fired is individually recorded here, with time, place and direction.

In particular, in step S3 several soldiers, i.e. several Tier3 PORs, take part in the shooting exercise. A fired-shot sensor 2 clearly assignable to the respective firearm 3 is here mounted on every firearm 3 of the participating soldiers as Tier3 PORs. Furthermore, the ammunition wallets of the soldiers as Tier3 PORs are directly linked to the corresponding fired-shot sensor 2, which may be firmly assigned to the respective soldier as a Tier3 POR in particular by using the firearm serial number and the personal ID.

In a subsequent step S4, the ammunition not expended during the shooting exercise in step S3 is returned by the soldier as a Tier3 POR to the head of exercise as the Tier2 POR. The fired-shot sensor 2 correspondingly assigned to the soldier as a Tier3 POR is here read preferably in wireless manner, for example by means of NFC/RFID, by the mobile communication device 7, and the corresponding shooting data is transmitted to the shooting log device 9 or its blockchain. The read shooting data is here stored together with the firearm data on the blockchain, and the shooting data and the firearm data are assigned to one another. How many cartridges were expended is determined based on the shooting data.

For every expended cartridge, a token in the ammunition wallet of the soldier as a Tier3 POR is destroyed. This means that a Smart Contract performs a function that burns the corresponding number of tokens. With this function, the tokens are sent to a blacklist ammunition wallet that makes it impossible to regain access to them. The tokens have thus irretrievably disappeared from the closed system, in the same way as the actually fired cartridges have.

By contrast, the remaining, i.e. unexpended, ammunition is, as already mentioned above, returned to the head of exercise as the Tier2 POR, wherein the corresponding number of returned cartridges is entered into the accounting system of the blockchain by means of the mobile communication device 7. This procedure represents a further checkpoint which is recorded by means of the mobile communication device 7 and stored on the blockchain. The tokens representing remaining cartridges, and to that extent unexpended ones, are transferred from the ammunition wallet of the soldier as a Tier3 POR back to the ammunition wallet of the head of exercise as the Tier2 POR. Thus there are no more tokens in the ammunition wallet of the soldier as a Tier3 POR at the end of the shooting exercise. They were either destroyed because all cartridges were expended, or transferred back to the head of exercise as the Tier2 POR upon return of the other cartridges.

Hence in step S4, after the end of the exercise, the firearm 3 with the fired-shot sensor 2 is again shown to the head of exercise as the Tier2 POR and the fired-shot sensor 2 is, together with all the shooting data collected, synchronized with the blockchain-based database and validated. The shooting data is inspectable by all authorized entities with the aid of the mobile communication device 7. If there is any discrepancy between the issued ammunition and the expended/returned ammunition when the rest of the ammunition is returned, i.e. if there is a delta between this ammunition and the number of tokens in the ammunition wallet, then the soldier as a Tier3 POR who fired the shots must answer to the head of exercise as the Tier2 POR and bear due responsibility for potential losses/discrepancies between the entered ammunition and the registered and actually expended ammunition.

With synchronization, the collected shooting data is transferred to the mobile communication device 7 in particular as an individual file wirelessly, for example by means of NFC or RIFD. This directly triggers a transaction which stores this file on the blockchain, and the tokens representing the cartridges actually fired are transferred to the blacklist ammunition wallet, from which the tokens can no longer be removed. Hence a cartridge that has been fired is permanently and irreversibly documented. Upon the return of the remaining cartridges, the head of exercise as the Tier2 POR enters the number of cartridges that he has received into the mobile communication device 7. This is also filed on the blockchain and offset against the number of issued and expended cartridges in order to determine a possible delta. The tokens of the returned cartridges are then transferred back into the ammunition wallet of the Tier2 POR. To that extent, the shooting log device 9 performs an integrity test on a location of the cartridges by means of data stored on the blockchain.

In a final step S5, the remaining ammunition previously returned in step S4 to the head of exercise as the Tier2 POR is given back to the head of depot as the Tier1 POR and put into storage in the ammunition depot. After verification by the head of depot as the Tier1 POR and after a corresponding entry into the accounting system, preferably by means of the mobile communication device 7, the corresponding tokens are transferred from the ammunition wallet of the head of exercise as the Tier2 POR back into the ammunition wallet of the head of depot as the Tier1 POR. This transfer too represents a checkpoint which is recorded by means of the mobile communication device 7 and stored on the blockchain.

At the end, therefore, the unused ammunition is back in the ammunition depot under the responsibility of the head of depot as the Tier1 POR, and the corresponding tokens are in the ammunition wallet of that person.

By means of the advantageous method described in the foregoing for ammunition monitoring using the advantageous ammunition monitoring system 1, which consists of several checkpoints at all relevant ammunition transfer points and of inalterable sensor data, it is possible, should ammunition be missing, to determine the exact place and the Person of Responsibility.

The shooting data that has been collected by the fired-shot sensor 2 is stored on the blockchain of the shooting log device 9. Every cartridge is represented on the blockchain as a single token, allowing the current stock to be precisely logged. After a cartridge has been fired, a corresponding token is clearly assignable to a fired-shot sensor 2, for which the corresponding firearm 3 and the person operating it is filed.

On the blockchain, every entity which passes on or uses ammunition has its own ammunition wallet. These ammunition wallets are assigned a certain number of cartridges corresponding to the number of cartridges which are at that moment in the area of responsibility of that entity. The transfer of ammunition, which is emulated on the blockchain by means of transactions from one wallet to another wallet, is verified by full nodes of the blockchain.

After reading of the shooting data at the mobile communication device 7, the shooting data is filed on the blockchain and the corresponding tokens are moved to the blacklist ammunition wallet, which documents all the shots fired and removes expended ammunition/tokens from the system, while preserving the data for later inspection. Alternatively, expended tokens may be permanently removed from the system by "burning" them, which however also means the loss of the corresponding data. Access by the mobile communication device 7 is by means of light nodes, where new transactions may be initiated on the blockchain.

To that extent, the blockchain of the advantageous ammunition monitoring system 1 permits a non-manipulatable lifecycle log for ammunition, wherein individual times for transfers of responsibility for the ammunition are always dependably trackable. The blockchain may be made accessible to further authorized entities at the discretion of the party responsible.

The invention claimed is:

1. An ammunition monitoring system with at least one fired-shot sensor assignable to a firearm and with a shooting log device, wherein the ammunition monitoring system is designed to record as shooting data, by means of the fired-shot sensor, the firing of at least one shot from the firearm, achievable by the discharge of a cartridge loaded into the firearm, and to store the recorded shooting data in the shooting log device, characterized in that the shooting log device has a blockchain data structure for filing of the shooting data, wherein the blockchain data structure has an accounting system for the cartridge which comprises a digital copy of the cartridge and covers the period at least from delivery, in particular from manufacture of the cartridge, to the shot being fired, wherein actual expending of the cartridge is determinable using the blockchain data structure based on shooting data and is loggable by irrevocable transfer of the digital copy of the cartridge into a blacklist ammunition wallet in tamper-proof manner.

2. The ammunition monitoring system according to claim 1, characterized in that for recording of the shooting data the at least one fired-shot sensor, in particular several fired-shot sensors, is, in particular are, mountable on or mounted on the firearm.

3. The ammunition monitoring system according to claim 1, characterized in that the fired-shot sensor has an acceleration sensor, a vibration sensor, a position sensor, a temperature sensor, a gyroscope, an angle sensor, an orientation sensor and/or an acoustic sensor, such that the fired-shot sensor is designed to record as shooting data at least the firing of the shot, in particular at least the firing of a sequence of shots, a number of shots, a firing angle and/or a firing position.

4. The ammunition monitoring system according to claim 1, characterized in that the fired-shot sensor has at least one storage device for at least temporary storage of the recorded shooting data.

5. The ammunition monitoring system according to claim 1, characterized in that the shooting log device is designed as a data server, in particular as a cloud-based data server, wherein the fired-shot sensor is designed to transmit the shooting data to the data server in wireless or wired manner.

6. The ammunition monitoring system according to claim 1, characterized in that the ammunition monitoring system has a mobile communication device, wherein the fired-shot sensor transmits the shooting data to the mobile communication device in wireless or wired manner, and that the mobile communication device comprises the shooting log device or transmits the shooting data to the shooting log device in wireless or wired manner.

7. The ammunition monitoring system according to claim 1, characterized in that the ammunition monitoring system has a plurality of further fired-shot sensors assignable to further firearms, wherein the firing of shots from the further firearms is recordable as shooting data by means of the further fired-shot sensors and storable in the shooting log device.

8. A method for ammunition monitoring, in particular using an ammunition monitoring system according to any of the above claims, wherein shooting data on the firing of at least one shot from a firearm, achieved by the firing of a cartridge loaded into the firearm, is recorded by at least one fired-shot sensor assigned to the firearm and stored in a shooting log device, characterized in that the shooting data is stored in a blockchain data structure, wherein accounting for the cartridge is conducted in the blockchain data structure, wherein a digital copy of the cartridge is generated for accounting purposes, and wherein accounting covers the period at least from delivery, in particular from manufacture of the cartridge, to the shot being fired, wherein actual expending of the cartridge is determined using the blockchain data structure based on the shooting data and is logged by irrevocable transfer of the digital copy of the cartridge into a blacklist ammunition wallet in tamper-proof manner.

9. The method according to claim 8, characterized in that the shooting data comprises the number, direction and/or position of the shot(s) fired.

10. The method according to claim 8, characterized in that the cartridge is assigned to at least one ammunition wallet for accounting purposes.

11. The method according to claim 8, characterized in that the shooting data is transmitted from the fired-shot sensor to the shooting log device in wireless or wired manner using a mobile communication device.

12. The method according to claim 8, characterized in that the shooting log device records firearm data of the firearm and assigns the shooting data and the firearm data to one another.

13. The method according to claim 8, characterized in that the shooting log device performs an integrity test on the location of the cartridge.

* * * * *